United States Patent [19]

Seidensticker et al.

[11] Patent Number: 4,557,437

[45] Date of Patent: Dec. 10, 1985

[54] PROCESS FOR FLIGHT-ATTITUDE-ADJUSTMENT OF A FLYING BODY AND/OR ACTIVATION OF LIVE LOAD CARRIED BY THE FLYING BODY AND ARRANGEMENT FOR CARRYING OUT THE PROCESS

[75] Inventors: Jens Seidensticker, Kaarst; Werner Grosswendt, Ratingen, both of Fed. Rep. of Germany

[73] Assignee: Rheinmetall GmbH, Duesseldorf, Fed. Rep. of Germany

[21] Appl. No.: 405,417

[22] Filed: Aug. 5, 1982

[30] Foreign Application Priority Data

Aug. 5, 1981 [DE] Fed. Rep. of Germany ..... 3130930

[51] Int. Cl.[4] ..... F41G 7/00; F42C 13/06

[52] U.S. Cl. ..... 244/3.21; 102/211

[58] Field of Search ..... 102/211, 214, 213; 244/3.15, 3.19, 3.21, 76 R; 114/21 A; 367/95, 87

[56] References Cited

U.S. PATENT DOCUMENTS

| | | | |
|---|---|---|---|
| 2,530,528 | 11/1950 | Kreer, Jr. | 114/21 A |
| 2,536,327 | 1/1951 | Tolson | 102/211 |
| 3,031,644 | 4/1962 | Hisserich et al. | 102/211 |
| 3,038,142 | 6/1962 | Wippert | 367/95 |
| 3,093,807 | 6/1963 | Crane et al. | 367/95 |
| 3,306,205 | 2/1967 | Marcus et al. | 102/211 |
| 3,852,705 | 12/1974 | Backman, Jr. et al. | 367/95 |
| 4,214,240 | 7/1980 | Weiss | 102/214 |
| 4,320,397 | 3/1982 | Constantinides | 367/95 |

FOREIGN PATENT DOCUMENTS

| | | | |
|---|---|---|---|
| 643935 | 7/1962 | Canada | 244/3.15 |
| 2846566 | 4/1980 | Fed. Rep. of Germany | 367/96 |
| 1337261 | 6/1962 | France | 102/211 |
| 2043899 | 10/1980 | United Kingdom | 367/95 |

*Primary Examiner*—Charles T. Jordan

[57] ABSTRACT

A process for controlling the flight attitude of a flying body and/or the activation of a useful live load on a flying body and the arrangement for carrying out the process. At least one receiving-emitting-unit for emitting and receiving energy in the form of ultra soundwaves is first emitted in bundled form from the unit and then reflected from the region immediately adjoining the flying body, for example, the ground surface, and received by the unit, whereupon the soundwaves are converted into electrical signals. By means of time lapse measurements of the emitted and reflected soundwaves there can, for example, be measured the distance of the flying body from the ground. If the flying body deviates from a predetermined flight path, control surfaces for correcting the flight path are adjusted by control means. Moreover, by means of the receiving-emitting-unit and via the control means a useful live load can be activated.

3 Claims, 5 Drawing Figures

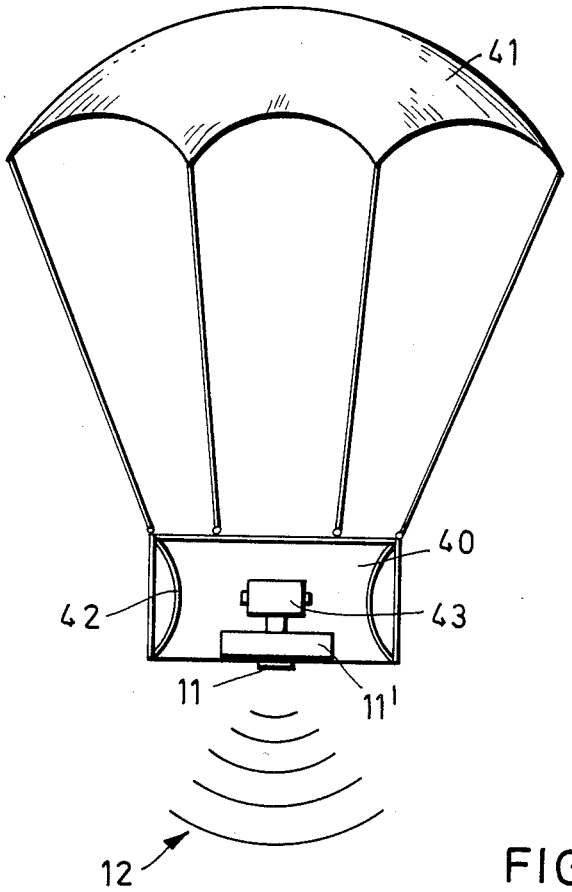
FIG. 4
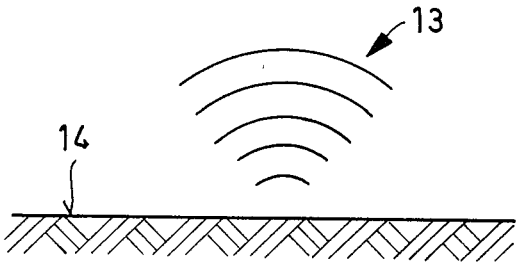

PROCESS FOR FLIGHT-ATTITUDE-ADJUSTMENT OF A FLYING BODY AND/OR ACTIVATION OF LIVE LOAD CARRIED BY THE FLYING BODY AND ARRANGEMENT FOR CARRYING OUT THE PROCESS

BACKGROUND OF THE INVENTION

This invention relates to a process for flight-attitude-adjustment of a flying body or activation of a useful live load which is being carried by the flying body or both and an arrangement for carrying out this process.

The invention has as an object to provide a process and arrangement of the aforedescribed type which is of particularly simple and rugged construction, so that it can be economically manufactured and at the same time have increased reliability of operation.

The term "flying body" in the sense of the instant invention encompasses all bodies capable of flight in the region of the atmosphere which are suitable for carrying a useful load.

In particular, those flying bodies which include their own propulsion motor are included in this category as well as projectiles which are fired from gun barrels and which travel without their own propulsion motor along a ballistic path and also useful load-carrying bodies which are expelled, for example from airplanes or rockets, over a target region.

It is an object of the invention to maintain a stable flight path for a body in flight with the aid of its own propulsion means which cause it to autonomously travel towards a target region, whereby, in particular, the maintenance of a predetermined height above ground of the flying body is a consideration, for purposes of, on the one hand, to avoid any obstacles and, on the other hand, to escape reconnaissance means. After the target region has been reached, the arrangement of the invention makes possible the activation of the useful live load which is being transported by the flying body at an optimum point in time.

With projectiles which are being fired out of gun barrels and which move along a substantially ballistic path, the arrangement of the invention makes possible the activation of the useful live load at a favorable point in time, that is when the target region has been reached.

Also, when the useful live load transport means are in the form of a rocket which is being fired from an airplane, this useful live load is, by means of the arrangement of the invention, activated at an optimum point in time, that is, at an optimum distance from a target region.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 4 is a useful live load support in the form of a descending parachute; and

DETAILED DESCRIPTION

Figure 1:
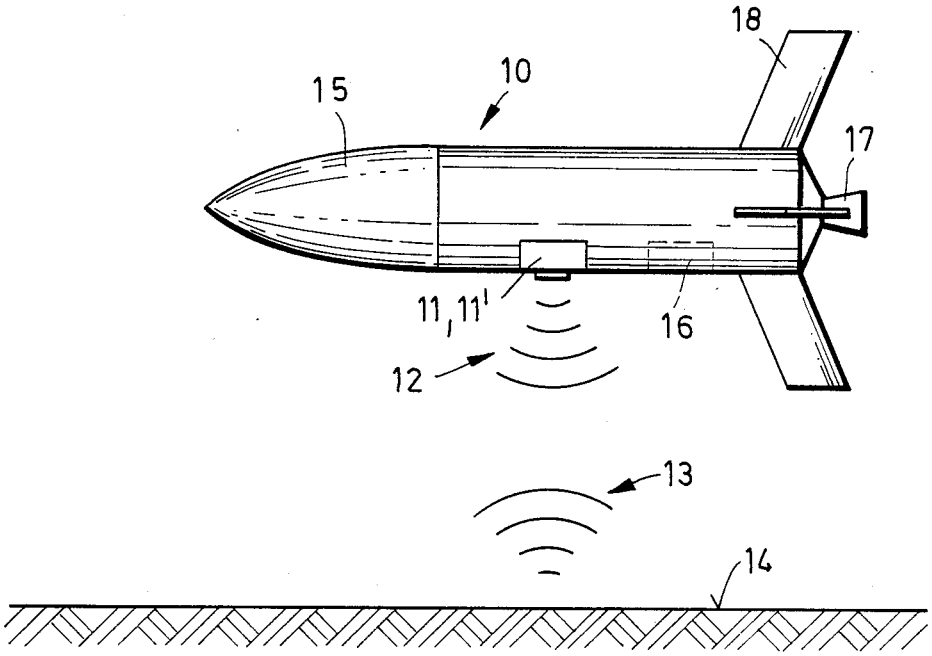
FIG. 1 is a schematic illustration of a flying body which moves at a predetermined distance over the surface of the earth.

In FIG. 1 there is schematically illustrated a flying body 10, which has its own propulsion means, for example a rocket motor 17, which moves at a predetermined distance over the surface of the earth 14 in direction towards a target region. In order to influence the position of the flying body 10, there is emitted energy from the flying body 10, preferably in pulsed form. Thereby, in accordance with the invention, the use of soundwaves is advantageously contemplated, in particular ultra soundwaves. These radiating soundwaves are illustrated in FIG. 1 schematically and are designated with the reference number 12. At least one portion of the radiated enery is reflected from a region near the flying body 10. What is meant by "a region near the flying body 10" in particular is the surface of the earth and the thereon situated targets or also targets which are actually in flight. At least one portion of the energy 13 which is being reflected from the surface of the earth 14, is advantageously spatially selectively received by the flying body 10.

In dependence with the received energy there are thereafter actuated means 16 which influence the attitude of the flying body 10 via control surfaces 18 along its flight path or which activate the useful live load which is being transported by the flying body 10. The influence and adjustment of the attitude of the flying body 10 is particularly concerned with the obstacles disposed on the surface of the earth 14 when the distance from the surface of the earth of a low-flying body is involved. A low height flight of the flying body 10 is desirable in order to avoid or escape reconnaissance means, such as for example a radar watch by the opposing side. In order to carry out the process of the invention, the flying body 10 has at its disposal at least one emitting unit 11 for radiating of sound energy in preferably pulsed form and at least one receiving unit 11' for preferably spatially selectively receiving the sound energy 13 which has been radiated by the emitter 11 and which has been reflected by the surface of the earth which is in the vicinity of the flying body. The emitter 11 and receiver 11' can be mounted in one unit and can be constructed in the simplest case in such a way that only one element is provided, which has a dual use of, on the one hand, emitting radiating sound energy, that is act as a sound emitter, and on the other hand, receiving sound energy, that is acting as a sound receiving unit.

Thus, advantageously the arrangement of the invention is time-multiplex-like switched between both types of operations. Combination emitting-receiving units for soundwaves, in particular ultra soundwaves, are already known per se. They consist, for example, out of ceramic masses, which are provided with contacts which, in the case of functioning as an emitter, are loaded with an alternate current, and as a result are mechanically excited to oscillate in the frequency of sound—respectively ultra sound regions. In the event the unit is functioning as a receiver, the element is brought into excitement for mechanical oscillations due to the impacting soundwaves and furnishes to the electrodes an alternate current voltage which can be detected therefrom. The desired pulsed radiation emission and spatially selective reception characteristic of the respective emitting unit and receiving unit can, in a known manner, by means of the form of the emitting-receiving elements or by means of additional reflectors which are joined to the emitting-receiving elements, be attained.

In order to determine the height of the flying body 10 over the ground surface it is only required to provide at least one emitting-receiving unit 11, respectively 11'.

Figure 2:
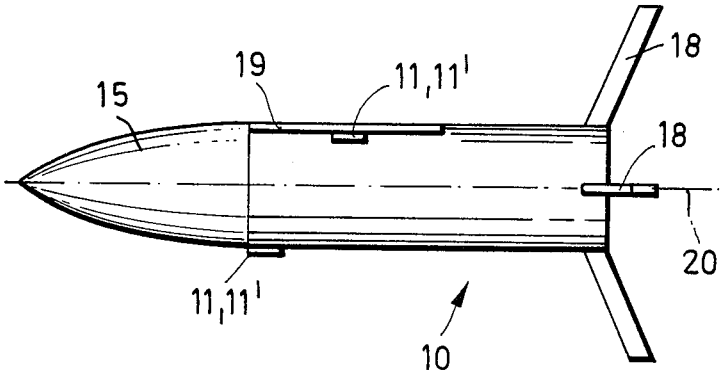
FIG. 2 is a side-elevational schematic view of another type of flying body.
Figure 3:
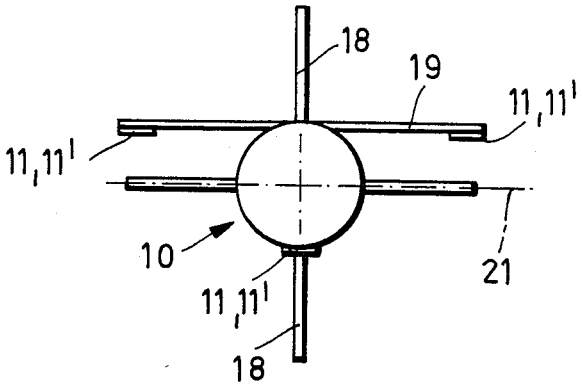
FIG. 3 is a rear-elevational view of a flying body of FIG. 2.

It is also easily possible, by using the process of the invention, to provide a plurality of emitting and receiving arrangements, which is hereafter explained in conjunction with FIGS. 2 and 3. The flying body 10, illustrated in the two figures, has a support surface 19, at each end of which there is mounted a receiving unit 11, 11'. By measuring the distance of the corresponding support surface and relative to the ground surface 14, the rolling motion about the longitudinal axis 20 of the flying body 10 can be controlled and influenced. A further receiving and emitting unit 11, 11', mounted on the hull or fuselage of the flying body 10 makes it possible to control and influence the pitch movement about the transverse axis 21 of the flying body 10. The previously mentioned axis-stabilization opens the possibility to strongly simplify the construction of a required search head unit for detecting a target region. This is due to the fact that such a search head unit only needs to measure the lateral deviation of the flying body relative to the target and correspondingly correct it.

Fig. 4 illustrates a further embodiment of the invention. There is illustrated schematically a disc-shaped useful live load support 40 which has been expelled from an airplane, jet plane or a rocket or an unmanned useful live load carrier over a target region and descends thereon via a parachute 41 which brakes its descent. In the aforementioned case the disc-shaped useful live load support carrier 40 includes effective units in the form of projectile-forming charges 42, the effect of the direction of action of which is substantially parallel to the ground surface 14. In the bottom portion of the useful live load carrier 40, there is arranged an emitting and receiving unit 11, 11', which emits ultra soundwave pulses which are reflected from the ground surface 14 and are received by the receiving unit. After reaching a predetermined optimum distance from the ground surface 14, there is actuated via the receiving unit 11' an ignition fuse 43 which causes the firing of the projectile-forming charges 42. The optimum ignition distance from the ground surface is advantageously predetermined and depends on the height of the expected target. Such useful live load carriers are suitable, for example, for combatting a concentration of tanks. In accordance with the invention the emitting and receiving means for ultra sound can have a particularly small and rugged construction, so that it can withstand also very high acceleration forces which occur during the discharging of useful live loads or during the firing of projectiles from gun barrels. Additionally, these emitting and receiving means can be inexpensively fabricated which is quite favorable for an economic mass production of the whole arrangement.

Figure 5:
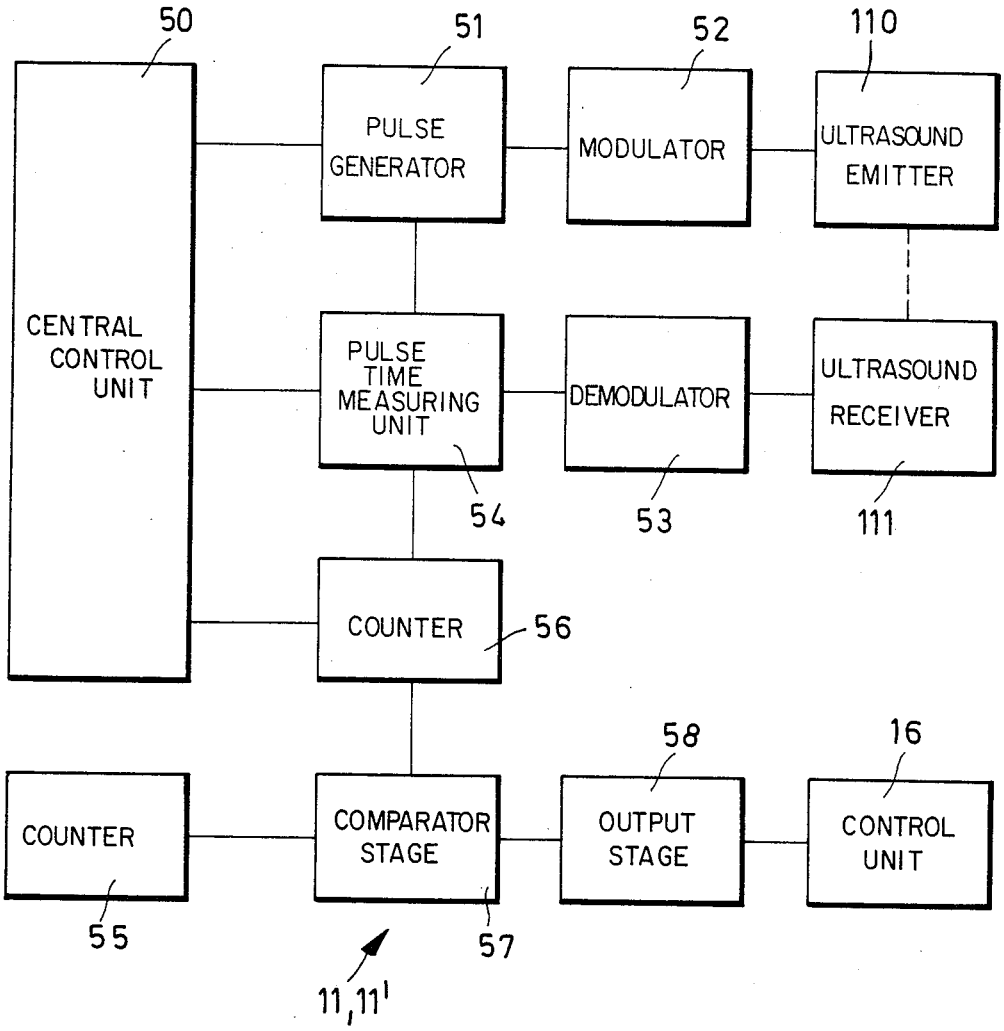
FIG. 5 is a schematic block circuit diagram of the emitting and receiving arrangement.

FIG. 5 illustrates a schematic circuit block diagram which explains the operation and functioning of an arrangement in accordance with the invention. A central control unit 50 coordinates all time lapses within the emitting-receiving unit 11, 11'. An ultra sound emitter 110 is loaded with pulses of a pulse generator 51 and is excited for releasing ultra soundwaves. Advantageously, the pulses emitted from the pulse generator are modulated by means of a modulator 52, for the purpose of, for example, to facilitate the evaluation of the soundwaves which are received by the ultra soundwave receiver after having been reflected. As has been mentioned herein above, the ultra soundwave emitter 110 and the ultra soundwave receiver 111 can be constructed in one unit as an ultra soundwave emitter 111 and an ultra soundwave receiver 111' or can be made out of the same element, whereby, according to the alternate operation as an emitter, respectively receiver, a time-multiplex-type control is required. The electrical signals which are emitted by the ultra soundwave receiver 11 are, first of all, demodulated in a demodulator 53 and thereafter are conducted to a further processing unit. Such unit includes preferably means for determining the distance of the flying body relative to a reference surface, which with known propagation velocity of the emitted and reflected ultra soundwaves is carried out, for example, by means of an elapsed pulse measuring unit 54.

For certain predetermined applications, for example the height measurement of the flying body 10 over the ground surface 14 or the distance measurement of an ignition unit according to FIG. 4, there is predetermined the optimum distance value via a first counter 55, A second counter 56 determines the distance value which is detectable from the time lapse measurement of the emitted and reflected sound signals. In a comparative circuit 57 there is determined whether both counted values correspond with or deviate from each other. By utilizing a distance measuring unit in an ignition unit there can be placed in operation the means 16 for activating the useful live load 10, according to the embodiment of FIG. 1, via an output stage 58 or the effective parts, in accordance with the embodiment of FIG. 4. In case of the flight position adjustment, there are, in contra distinction hereto, at departure of the counting stage, the control surfaces 18 and/or not illustrated jet valves which, placed into operation by also provided for correction drive means, are set in motion via the output stage 58 and the control unit 16 until the counting stage mutually coincide again and the predetermined flight path is again assumed.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. In an improved arrangement for controlling the flight attitude of a winged flying body or the activation of a useful live load being transported by a flying body, or both, the improvement comprising:

three combined emitter-receiver units for radiating ultrasound energy in pulsed modulated form and spatially selectively receiving the energy which, after being radiated is then reflected by objects in the vicinity of said flying body;

one emitter-receiver unit is located at the outer most region of each wing of said winged flying body and one emitter-receiver unit is mounted on the underside of the flying body in a different vertical plane than the wing mounted emitter-receiver units;

means for actuating one of the functions selected from the group of functions which consists of flight attitude control or activation of a useful live load of a flying body in response to the received energy;

a central control unit connected to a pulse generator for controlling time lapses within each emitter-receiver unit;

a modulator connected to each emitter-receiver unit such that the pulse generator controls the emission of ultrasound via the modulator;

a pulse time measuring unit connected to said central control unit for measuring the emitted and reflected ultrasound signals;

first and second counters, said first counter being adjustable to a predetermined value and said second counter connected to said pulse time measuring unit to indicate the value which has been determined by said pulse time measuring unit;

a comparator stage connected to both counters to receive the counted pulse signals therefrom and to emit control signals in dependence on the comparison values processed in said comparator stage;

an output stage connected to said comparator stage and a second control unit to adjust and control the flight attitude of the flying body or the activation of a useful load of the flying body, or both in accordance with the control signals received from the output stage.

2. An improved arrangement for controlling the flight attitude of a winged flying body or the activation of a useful live load being transported by a flying body, or both, the improvement, as described in claim 1, further comprising:

a plurality of movable control surfaces extending outward from the flying body, the movement of said control surfaces being controlled by said second control unit.

3. An improved arrangement for controlling the flight attitude of a winged flying body or the activation of a useful live load being transported by a flying body, or both, the improvement, as described in claim 1, further comprising:

a plurality of control jets mounted on the flying body, the activation of each of said control jets being controlled by said second control unit.

* * * * *